428-570 SR

11/13/84 XR 4,482,607

United States Patent [19]

Neelameggham et al.

[11] Patent Number: 4,482,607

[45] Date of Patent: Nov. 13, 1984

[54] METHOD FOR COATING MAGNESIUM GRANULES WITH FLUORIDE-CONTAINING FLUX

[75] Inventors: Ramaswami Neelameggham, Salt Lake City, Utah; John C. Priscu, Las Vegas, Nev.

[73] Assignee: Amax Inc., Greenwich, Conn.

[21] Appl. No.: 421,887

[22] Filed: Sep. 23, 1982

[51] Int. Cl.[3] ..... B32B 5/16

[52] U.S. Cl. ..... 428/403; 427/216; 427/405; 427/431; 427/436; 428/570

[58] Field of Search ..... 427/216, 434.3, 434.4, 427/431, 405, 436, 41, 9, 1; 428/570, 403; 75/251, 254

[56] References Cited

U.S. PATENT DOCUMENTS 3,202,537 8/1965 Norman et al. ..... 427/216
3,247,297 4/1966 Salesse ..... 427/216
3,973,061 8/1976 Easwaran et al. ..... 427/431
4,331,711 5/1982 Skack et al. ..... 428/403

*Primary Examiner*—Norman Morgenstern
*Assistant Examiner*—Janyce A. Bell
*Attorney, Agent, or Firm*—Michael A. Ciomek; Eugene J. Kalil

[57] ABSTRACT

A method is provided for coating magnesium granules with a fluoride-containing salt comprising contacting the granules with at least one fluoride-containing salt selected from the group consisting of alkali and alkaline earth metal fluorides and fluoborates and thereby produce a fluoride-containing coating on the surface of the granules. The coating is characterized in that the oxidation of the magnesium granules is greatly inhibited during the use of the granules as an addition agent to a molten metal bath, for example, when used in the desulfurization of steel.

7 Claims, No Drawings

METHOD FOR COATING MAGNESIUM GRANULES WITH FLUORIDE-CONTAINING FLUX

This invention relates to a method for coating magnesium granules with a substantially non-hygroscopic fluoride-containing flux particularly suitable as a desulfurizing agent for steel.

STATE OF THE ART

Magnesium is employed as an external addition to molten iron or steel to reduce sulfur and oxygen, thus improving the physical and chemical properties of the final product.

For example, in the casting of ferrous metals it is the usual procedure to add a deoxidizing agent such as Mg, Al, etc., before casting in order to deoxidize the molten ferrous metal of absorbed oxygen which can adversely affect the physical properties of the finished product.

In addition to deoxidation, some metal products require a reduction of sulfur content which also has an adverse effect on the physical properties of finished product.

Magnesium, a strong desulfurizing agent, has been found very useful for that purpose since it is a very reactive element at elevated temperatures. When introduced under the surface of molten iron or steel at temperatures of about 2300° F. to 2700° F., the magnesium which has a boiling point of 2024.8° F., vaporizes and reacts violently with the oxygen and sulfur in the steel. The gas bubbles quickly rise to the surface along with bubbles of expanded inert carrier gases. This action is hazardous and causes molten metal to splash with the consequent loss of metal and reagent. Another problem is the tendency for superheated magnesium to react with air which results in a voluminous dense cloud of magnesium oxide dust.

It has been found convenient to add the magnesium in the form of granules coated with fused salt mixtures containing NaCl, KCl, $CaCl_2$, $MgCl_2$, and the like. These mixtures may also contain oxides of these elements. The coated granules are injected well below the molten iron or steel surface through a lance using a stream of suitable carrier gas at a rate to control the reaction violence to assure a beneficial stirring action, while minimizing loss of magnesium vapor to the atmosphere.

The salt coating is claimed to avoid plugging of the lance, to slow the rate of reaction and to better control the addition rate of the granules. Another advantage of the chloride coating is to reduce the pyrophoricity of the magnesium granules, and to protect the granules from corrosion in air in the shipping container. However, a disadvantage of these salt mixtures is that they are somewhat hygroscopic, and have a tendency to absorb moisture on exposure to air which causes "caking" of the granules. Also on long time exposure, the magnesium granule will corrode and form hydrous oxides or hydroxy chlorides.

It is known to coat magnesium granules with clay slips, bentonite, and the like, which coating tends to cause caking of the granules.

It would be desirable to provide flux-coated magnesium granules which are substantially non-hygroscopic and can be easily handled when being added to a molten metal bath, such as steel. The flux should also aid in inhibiting pyrophoricity at elevated temperatures.

OBJECT OF THE INVENTION

It is thus an object of the invention to provide a method for producing substantially non-hygroscopic flux-coated magnesium granules characterized by reduced pyrophoricity.

Other objects will clearly appear when taken in conjunction with the following disclosure and the appended claims.

STATEMENT OF THE INVENTION

The desulfurizing agent provided by the invention comprises magnesium granules having a surface coating consisting essentially of a fluoride-containing salt.

Examples of such salts are alkali and alkaline earth metal fluorides and fluoborates. The term "fluoride-containing salts" as employed hereinabove includes fluoborates. Examples of such salts are NaF, KF, $NaBF_4$, $KBF_4$, $CaF_2$, $CaBF_6$, and the like.

The mineral fluorspar ($CaF_2$) is well known as a flux in steel making and is particularly useful as a flux coating for magnesium.

DETAILS OF THE INVENTION

As the main purpose for the flux coating is to reduce pyrophoricity, a simple test may be employed in which a small pile of granules, coated and uncoated, is subjected to the direct flame of a Bunsen burner or a propane torch. A typical pile for testing is one weighing about 100 grams.

The pile is supported on a high temperature resistant insulating board and exposed to the flame. The granules prior to coating has a size of −10 mesh (U.S. Standard), the average size ranging from about 50 mesh to 10 mesh. The granules tested included the following: (1) no coating, (2) chloride salts, (3) fluorspar-fluoborate mix, (4) iron-coated granules with precipitated fluoride on the surface, (5) dry coating of $KBF_4$ with $Al_2O_3$, and (6) dry coating of $KBF_4$ alone.

The results are determined in terms of burning time following application of the flame as follows:

| Type of Coating | Burning Time, Secs. | Comments |
|---|---|---|
| (1) None | 7–10 | Ignition spreads rapidly from one granule to another. |
| (2) Chloride Salts | 180–200 | Initially, the melting of the chloride salts provides a flux cover and then oxidizes enough to cause the granules to burn. |
| (3) Fluorspar-Fluoborate Mix | 150–200 | The flux coating gets red hot without the magnesium burning until later, similarly to the chloride coating. |
| (4) Iron-Coated Mg with Precipitated Fluoride on Surface | 200–270 | Similar to test 3. |
| (5) Dry Coatings of $KBF_4$ with $Al_2O_3$ | 300 plus | This flux when melted protects the granules for a longer period than test 2. |
| (6) Dry Coating of $KBF_4$ | 300 plus | This flux when melted protects the granules for a longer period than test 2. |

As stated earlier, an advantage of the fluoride-containing flux is that it is substantially non-hygroscopic and also is at least as good as, if not better, as a flux coating for magnesium granules than the chloride flux.

The flux-coated magnesium granules of the invention is particularly useful for the desulfurization of steel. The practice of steel-making is well known and need not be repeated here.

The steel bath is established using well-known techniques and the bath subsequently desulfurized by adding to it a measured amount of the fluoride-coated granules. As the flux coating melts, it protects the magnesium against pyrophoricity as it melts and is being absorbed by the steel bath. The magnesium reacts with the contained sulfur to form magnesium sulfide which is taken up by flux or slag on the surface of the molten steel bath. Steel ingots are then cast in ingot molds in the well-known manner.

One embodiment of the method comprises contacting granules of magnesium with at least one fluoride-containing salt in a manner to produce a surface coating on said granules characterized such that the oxidation of said granules is greatly inhibited during the addition of the coated granules to the molten steel bath.

Another embodiment of the invention resides in providing the granules with a coating in the form of a mixture of fluorspar and a fluoborate, such as $NaBF_4$, $KBF_4$, etc. Alkaline earth fluoborates may also be employed.

The fluorspar-fluoborate coating may be applied as a molten slurry of the two ingredients.

In a further embodiment, the surface coating may be produced by first applying a layer of iron followed by treating the even-surfaced magnesium with an aqueous fluoride solution and thereby provide a fluoride coating containing iron. The method of applying iron to the magnesium surface is by chemical deposition from an aqueous bath containing ferrous ions.

As illustrative of the various methods than can be employed, the following examples are given.

EXAMPLE 1

A fluorspar-fluoborate mix is produced by forming a molten slurry of 5% by weight of fluorspar in a 500-gram bath of potassium fluoborate (or sodium fluoborate) at a temperature of about 550° C. which is lower than the melting point of magnesium (652° C.). About 100 grams of magnesium granules are mixed with the bath and following solidification the solidified mix is broken into −10 mesh particles with the magnesium substantially distributed through the flux matrix. The fines are removed by screening, leaving coated magnesium granules. The coating on the granules may range up to about 15% by weight of the total granules.

EXAMPLE 2

A dry coating of $KBF_4$ with $Al_2O_3$ is produced as follows:

About 100 grams of magnesium granules (ranging from 100 mesh to 10 mesh) are mixed with 30 grams of flux mixture comprising a mixture of 20% −600 mesh $Al_2O_3$ and 80% $KBF_4$.

Following mixing in a blender, the granules are coated with the flux composition to provide a coating containing $KBF_4$—$Al_2O_3$.

The fines are then screened out to provide a coated magnesium granules comprising 95% magnesium metal.

EXAMPLE 3

Magnesium granules are provided with a coating of iron by using one of three solutions as follows:

(1) A ferrous ammonium sulfate with a citrate buffer and neutralized with $NH_4OH$. The solution prepared contains 50 grams/liter of $Fe^{++}$, 2 grams/liter (gpl) of sodium citrate and enough $NH_4OH$ to provide a pH of 6.

The granules are added to the solution and iron deposited chemically on the surface thereof. The granules are thereafter washed preparatory to forming a flux coating thereon.

(2) A ferrous ion solution is prepared by dissolving 50 gpl of ferrous chloride and 50 gpl of calcium chloride in water. The solution is neutralized with $Ca(OH)_2$ to pH 6. Granules are added to the solution and an iron chemically deposited on the surface thereof. The iron-coated magnesium granules are water washed as stated above.

(3) ferrous fluoborate is dissolved in water to provide a solution containing 100 gpl of the salt. Thereafter, iron is chemicaly deposited upon the magnesium granules and the iron-coated granules thereafter washed.

Following production of the magnesium granules with a layer of metallic iron, the granules are treated with a 1% solution of sodium fluoride or hydrogen fluoride to provide a fluoride outer coating by reaction. The coating on the granules may range from about ½ to 5% by weight of the coated granules.

The fluoride-containing coating comprises an effective amount ranging up to about 15% by weight of the coated granules (e.g., about ½ to 15%), for example, about ½ to 8%, a preferred range being about ½ to 5%. Prior to coating, the magnesium granules have an average size ranging from about 100 to 10 mesh (U.S. standard).

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In a method of producing coated magnesium granules for use as an addition agent in the treatment of molten metal baths, the improvement which comprises, contacting granules of magnesium with a salt consisting essentially of a mixture of fluorspar and a fluoborate of a metal selected from the group consisting of alkali and alkaline earth metals and thereby produce a coating thereof on the surfaces of said granules characterized in that the surface coating is substantially non-hygroscopic and in that the oxidation of said granules is greatly inhibited during addition of said granules to said molten metal bath.

2. The method of claim 1, wherein the surface coating is produced by treating magnesium granules in a molten slurry of fluorspar and alkali metal fluoborate.

3. In a method of producing coated magnesium granules for use as an addition agent in the treatment of molten metal baths, the improvement which comprises, applying a layer of iron to the surfaces of said granules, contacting said iron-coated magnesium granules with an aqueous solution of at least one fluoride salt selected from the group consisting of alkali and alkaline earth metal fluoborates and thereby produce a fluoride coating on said iron-coated granules characterized in that the fluoride coating is substantially non-hygroscopic and in that the oxidation of said granules is greatly inhibited during addition of said granules to said molten metal bath.

4. The method of claim 3, wherein the iron surfaced granules are produced by contacting said granules with an aqueous solution containing ferrous ions and thereby produce a layer of chemically deposited iron thereon, and washing said iron-surfaced granules prior to producing a fluoride-containing coating thereon.

5. In a method of producing coated magnesium granules for use as an addition agent in the treatment of molten metal baths, the improvement which comprises, contacting granules of magnesium of average size ranging from about 100 to 10 mesh with a salt consisting essentially of at least one fluoride salt selected from the group consisting of alkali and alkaline earth metal fluoborates and thereby provide a surface coating consisting essentially of said at least one fluoride salt on said granules characterized in that the amount of surface coating ranges from an effective amount up to about 15% by weight of the coated granules, in that the surface coating is substantially non-hygroscopic and in that the oxidation of said granules is greatly inhibited during addition of said granules to said molten metal bath.

6. The method of claim 5, wherein the fluoride salt is $KBF_4$.

7. The method of claim 1, wherein the amount of coating ranges from about ½ to 8% by weight.

* * * * *